US008683627B2

(12) United States Patent
Rippe et al.

(10) Patent No.: US 8,683,627 B2
(45) Date of Patent: Apr. 1, 2014

(54) MATTRESS AND BED DECK COVER

(75) Inventors: Bruce M. Rippe, Batesville, IN (US); Catherine Marie Wagner, Osgood, IN (US); Douglas E. Borgman, Brookville, IN (US); Bernard F. Voegele, Batesville, IN (US); David John Ulrich, Sunman, IN (US)

(73) Assignee: Trinity Guardion, LLC, Batesville, IN (US)

( * ) Notice: Subject to any disclaimer, the term of this patent is extended or adjusted under 35 U.S.C. 154(b) by 191 days.

(21) Appl. No.: 12/804,059

(22) Filed: Jul. 13, 2010

(65) Prior Publication Data

US 2011/0005000 A1 Jan. 13, 2011

Related U.S. Application Data

(60) Provisional application No. 61/270,739, filed on Jul. 13, 2009.

(51) Int. Cl.
*A47G 9/02* (2006.01)

(52) U.S. Cl.
USPC ..... 5/497; 5/482; 5/484; 5/496; 5/498; 5/499

(58) Field of Classification Search
USPC ..... 5/482, 484, 485, 495–499, 413 AM, 5/613, 737
See application file for complete search history.

(56) References Cited

U.S. PATENT DOCUMENTS

| | | | | |
|---|---|---|---|---|
| 1,137,220 | A | 4/1915 | Lehmann | |
| 2,791,784 | A | 5/1957 | Tomsic | |
| 4,734,947 | A * | 4/1988 | Vitale | 5/493 |
| 5,046,207 | A * | 9/1991 | Chamberlain | 5/496 |
| 5,911,654 | A | 6/1999 | Webb | |
| 6,185,766 | B1 | 2/2001 | Farrugia | |
| 6,631,529 | B1 | 10/2003 | Erickson | |
| 7,093,310 | B2 * | 8/2006 | Barros | 5/482 |
| 7,120,952 | B1 | 10/2006 | Bass et al. | |
| 7,222,377 | B2 | 5/2007 | Kramer et al. | |
| 7,325,263 | B2 | 2/2008 | Stribling | |
| 7,353,550 | B2 | 4/2008 | Antinori | |
| 7,754,625 | B2 * | 7/2010 | Hendriks et al. | 442/123 |
| 7,930,779 | B2 * | 4/2011 | Marrache | 5/498 |
| 2007/0151028 | A1 | 7/2007 | Bauer | |
| 2007/0189932 | A1 | 8/2007 | Glenn et al. | |
| 2007/0199155 | A1 | 8/2007 | Thygsen | |
| 2009/0056030 | A1 | 3/2009 | Bolden | |
| 2009/0064415 | A1 | 3/2009 | Payne et al. | |
| 2010/0281613 | A1 | 11/2010 | Hillenbrand, II | |

FOREIGN PATENT DOCUMENTS

| | | |
|---|---|---|
| EP | 1316635 A2 | 4/2003 |
| FR | 1112549 | 3/1956 |
| GB | 1193872 | 6/1970 |

OTHER PUBLICATIONS

International Search Report, Form PCT/ISA/210, 2 pages, for International Application No. PCT/US11/00058 completed on Mar. 3, 2011 and mailed Mar. 25, 2011.
International Search Report, Form PCT/ISA/210, 3 pages, for International Application No. PCT/US10/01958 completed on Aug. 20, 2010 and mailed Sep. 1, 2010.
European Search Opinion for Application No. EP 10800152.0.
Supplementary European Search Report for Application No. EP 10800152.0.

* cited by examiner

*Primary Examiner* — Nicholas Polito
(74) *Attorney, Agent, or Firm* — Bingham Greenebaum Doll LLP; James C. Eaves, Jr.; Brian W. Chellgren

(57) ABSTRACT

The present invention relates to a cover for a mattress and bed deck. More particularly, the present invention relates to a mattress and bed deck cover for an adjustable bed that reduces the exposure of the mattress and bed deck to unsanitary conditions.

20 Claims, 6 Drawing Sheets

MATTRESS AND BED DECK COVER

This application claims the benefit of U.S. Provisional Patent Application Ser. No. 61/270,739, entitled MATTRESS AND BED DECK COVER, to Bruce M. Rippe, David J. Ulrich, Catherine M. Wagner, Douglas E. Borgman, and Bernard F. Voegele, filed Jul. 13, 2009 and incorporated herein by reference.

BACKGROUND OF THE INVENTION (a) Field of the Invention

The present invention relates to a cover for a mattress and bed deck. More particularly, the present invention relates to a mattress and bed deck cover for an adjustable bed that reduces the exposure of the mattress and bed deck to unsanitary conditions.

(b) Description of the Prior Art

Mattress covers are commonly used to protect mattresses from staining, soiling, or other results of contact with unsanitary conditions. The need for effective mattress covers is greater in a healthcare setting, where contact with large scale contaminants, such as blood or waste products, and small scale contaminants, such as bacteria or fungi, is a daily occurrence. Mattress covers must be cleaned on a regular basis to maintain a sanitary environment.

Mattresses are supported by bed decks. Bed decks may come into contact with the same unsanitary conditions as mattresses and mattress covers. For example, waste produced by a patient may flow off the mattress or mattress cover and accumulate on the supporting bed deck. Under current techniques, the cumbersome mattress must be manually raised from the bed deck, the bed deck cleaned by hand using a germicidal solution, and the mattress replaced atop the bed deck. However, hospital workers may neglect to clean the bed deck, or may not fully clean the entire surface of the bed deck. Furthermore, manual cleaning may not be sufficient to eliminate bacteria embedded in the bed deck or kill fungal spores. Any remaining contamination may be passed from the bed deck to clean mattress covers or bed sheets, from which the contaminants may contact a patient.

A need exists for a removable cover that protects both mattresses and bed decks from unsanitary conditions and is capable of being laundered. This need is complicated in a healthcare environment, where mattresses and bed decks are incorporated into adjustable beds. Adjustable beds used in healthcare settings include bed decks and mattress which can be raised, lowered, and articulated into various configurations. A need exists for a removable cover for the mattress and bed deck of an adjustable bed that is capable of protecting and remaining attached to the mattress and bed deck while the adjustable bed adopts different configurations.

SUMMARY OF THE INVENTION

The aforementioned problems have been solved in the present invention, which provides a mattress and bed deck cover. More particularly, the present invention relates to a mattress and bed deck cover for an adjustable bed that reduces the exposure of the mattress and bed deck to unsanitary conditions.

Conventional bedding utilizes a fitted sheet that encapsulates the top and sides of a mattress, and a flat sheet and one or more blankets that are tucked into the space between the mattress and the supporting bed deck or box spring. One difficulty with using a single cover to protect both the mattress and the bed deck is that access to the space between the mattress and bed deck would be lost and bedding material could not be tucked into that space. The present invention solves this problem by including a channel at the head end of the cover, whereby a fitted sheet may be wrapped around the head end of the mattress, and a channel at the foot end of the cover, whereby a fitted sheet may be wrapped around the foot end of the mattress and a flat sheet and blankets may be tucked between the mattress and bed deck.

Adjustable beds, as used in hospitals and other healthcare settings, can be raised, lowered, and adjusted into various configurations. The present invention is capable of remaining in position on the mattress and bed deck while the adjustable bed adopts different configurations. While the bed is positioned horizontally, the mattress and bed deck cover fits tautly over the bed. A taut cover eliminates folds and gathers in which waste may accumulate and which may cause pressure ulcers. Furthermore, the present invention may include at least one flap to cover specific areas of the adjustable bed, such as the pivot points, which may be more susceptible to contamination.

Adjustable beds, as used in hospitals and other healthcare settings, may incorporate devices or controls, such as, for example, emergency release handles used to lower the head end of the adjustable bed as required to administer CPR. Access to these devices or controls cannot be restricted by the mattress and bed deck cover. The present inventions solves this problem by providing a sufficient number of cutouts to grant access to devices incorporated into the bed deck, while still protecting the bed deck from contamination and remaining securely attached to the mattress and bed deck. Cutouts may also be included to allow the mattress and bed deck cover to fit around bed rails, handles, other structural features of adjustable beds.

Certain inorganic agents, such as metal ions, are known to have antimicrobial and antifungal activity. Silver is known as a broad spectrum antibiotic with minimal health concerns. Copper is known to have antifungal activity and a synergistic effect with silver against bacteria. Zinc has weak antimicrobial activity and the ability to moderate the release of silver from a carrier. While there is a low frequency of bacteria developing resistance to silver, exposure to sub-lethal concentrations of silver may increase the chance of resistance development.

The present invention combines the antimicrobial and antifungal properties of metal ions with the need for more hygienic surfaces in bedding. In this embodiment, the present invention relates to the incorporation of metal ions into a film coating applied to a mattress and bed deck cover. More particularly, the present invention relates to a mattress and bed deck cover coated with a film coating material incorporating soluble glass carriers containing silver. A particular advantage of this embodiment of the present invention over surface treatment of bedding material with antimicrobial agents is that metal ions are not released into the environment, but kill on contact. By providing a substantially nonleaching film coating, metal ions are not released into the environment, reducing the risk of bacteria developing resistance due to exposure of sub-lethal concentrations of metal ions. Thus the present invention provides the antimicrobial effectiveness of metal ions while minimizing the chances of creating bacterial strains resistant to the antimicrobial activity of metal ions. Another particular advantage of this embodiment is that incorporation of antimicrobial and antifungal properties into the present invention reduces odors.

The mattress and bed deck cover is designed to be laundered using U.S. Center for Disease Control-approved healthcare laundering techniques, e.g., washing with detergent in water at a temperature greater or equal to 160° F. (71° C.) for at least 25 minutes. Conventional mattress covers are manufactured using fabric welds to prevent fluids from wicking through the cover to the mattress. However, standard fabric welds tend to break during repeated laundering cycles. In addition, standard healthcare laundering techniques may not be sufficiently intense to eliminate bacteria embedded in a conventional mattress cover. In the present invention high strength welds are used which are capable of withstanding the agitation and high temperature of the laundering process. Furthermore, the antimicrobial film coating of the cover kills bacteria and prevents them from becoming embedded in the cover. Therefore, a standard healthcare laundering process is sufficiently intense to decontaminate the present invention, whereas it would not be sufficient to decontaminate a cover without such a film coating.

In one embodiment, the present invention is a mattress and bed deck cover, the cover comprising: a top surface; a head end descending from the top surface; a foot end descending from the top surface and opposing the head end; a pair of opposing sides descending from the top surface and substantially perpendicular to the head end and the foot end and connected thereto; means for removably fixing the cover in relation to a mattress and a bed deck; a head end channel extending the width of the head end and a portion of the length of the sides; and a foot end channel extending the width of the foot end and a portion of the length of the sides; wherein the cover is sized to enclose a mattress and at least a portion of a bed deck, with the head end channel and the foot end channel oriented to interpose a portion of the mattress and the bed deck. In this embodiment, the cover may further comprise at least one cutout corresponding to the shape and location of at least one device attached to the bed deck. The cover may also comprise at least one flap descending from at least one of the pair of sides and removably attachable to a bed incorporating the bed deck. In this embodiment, the cover is constructed of a liquid-impermeable, multi-directional stretch fabric including a substantially nonleaching antimicrobial film coating. The cover may incorporate an agent with antimicrobial and/or antifungal properties, such as an antimicrobial metal, more specifically, silver ions contained within glass carriers.

In a further embodiment, the present invention is a mattress and bed deck cover comprising a top surface; a head end descending from the top surface; a foot end descending from the top surface and opposing the head end; a pair of opposing sides descending from the top surface and substantially perpendicular to the head end and the foot end and connected thereto; at least one elastic band; a head end channel extending the width of the head end and a portion of the length of the sides; and a foot end channel extending the width of the foot end and a portion of the length of the sides; wherein the cover is sized to enclose a mattress and at least a portion of a bed deck, with the head end channel and the foot end channel oriented to interpose a portion of the mattress and the bed deck. In this embodiment, the elastic band is attached to the sides of the cover for drawing the cover beneath the bed deck for retention. The cover also includes at least one magnet and at least one hook for removably attaching the cover to the bed deck. The cover further comprises at least one strap, the at least one elastic band and the at least one strap for cooperatively drawing the cover beneath the bed deck for retention. In this embodiment, the cover further comprises a substantially nonleaching antimicrobial film coating. The cover also comprises at least one flap descending from at least one of the pair of opposing sides and removably attachable to a bed incorporating the bed deck, the flaps each including a magnet for removably attaching the flap to the bed. In this embodiment, the cover also includes at least one cutout corresponding to the location and shape of at least one device attached to the bed deck.

BRIEF DESCRIPTION OF THE DRAWINGS

A better understanding of the present invention will be had upon reference to the following description in conjunction with the accompanying drawing, wherein.

DETAILED DESCRIPTION OF THE PREFERRED EMBODIMENT

Figure 1A:
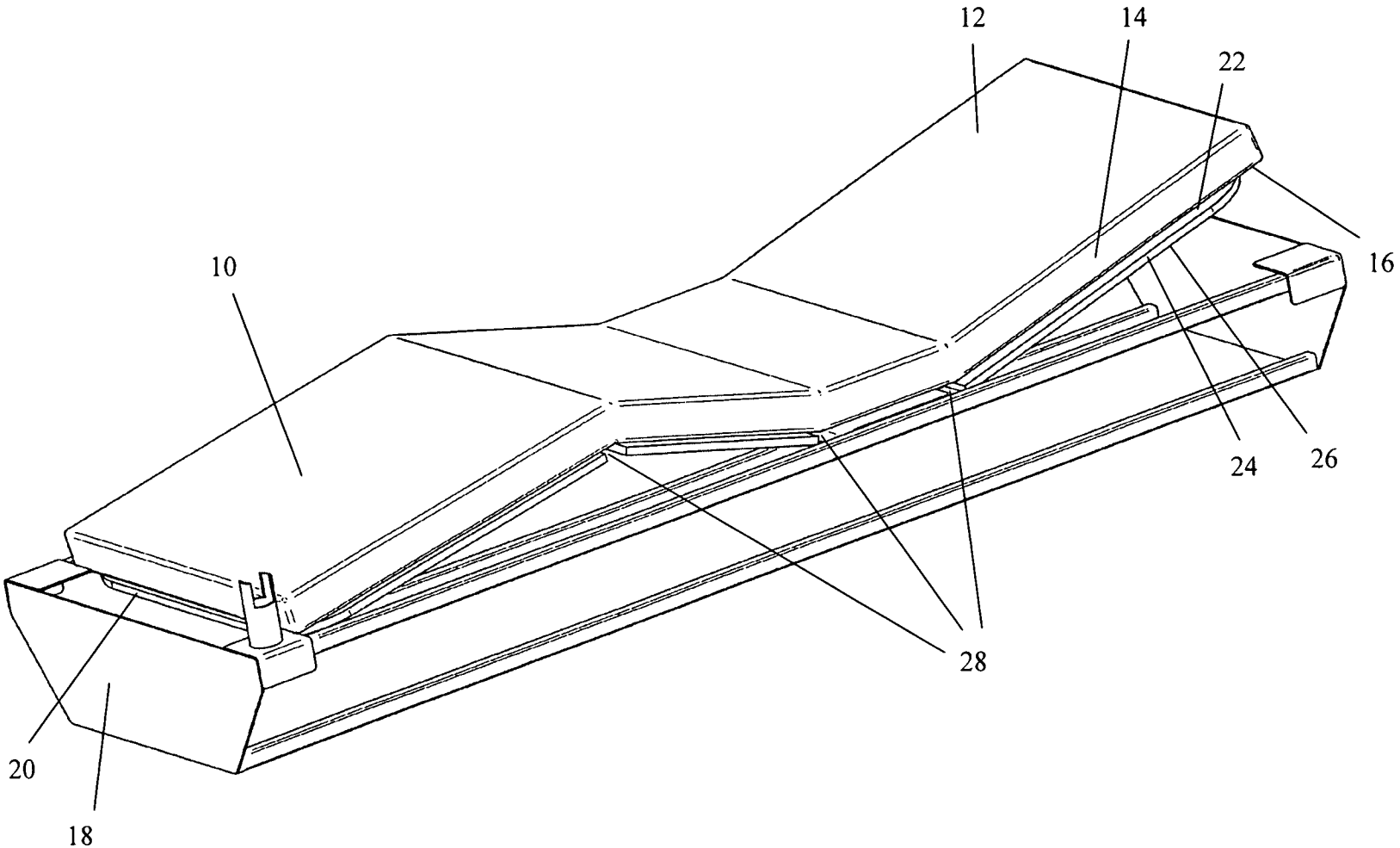
FIG. 1A depicts a foot end perspective view of an adjustable bed and a mattress.
Figure 1B:
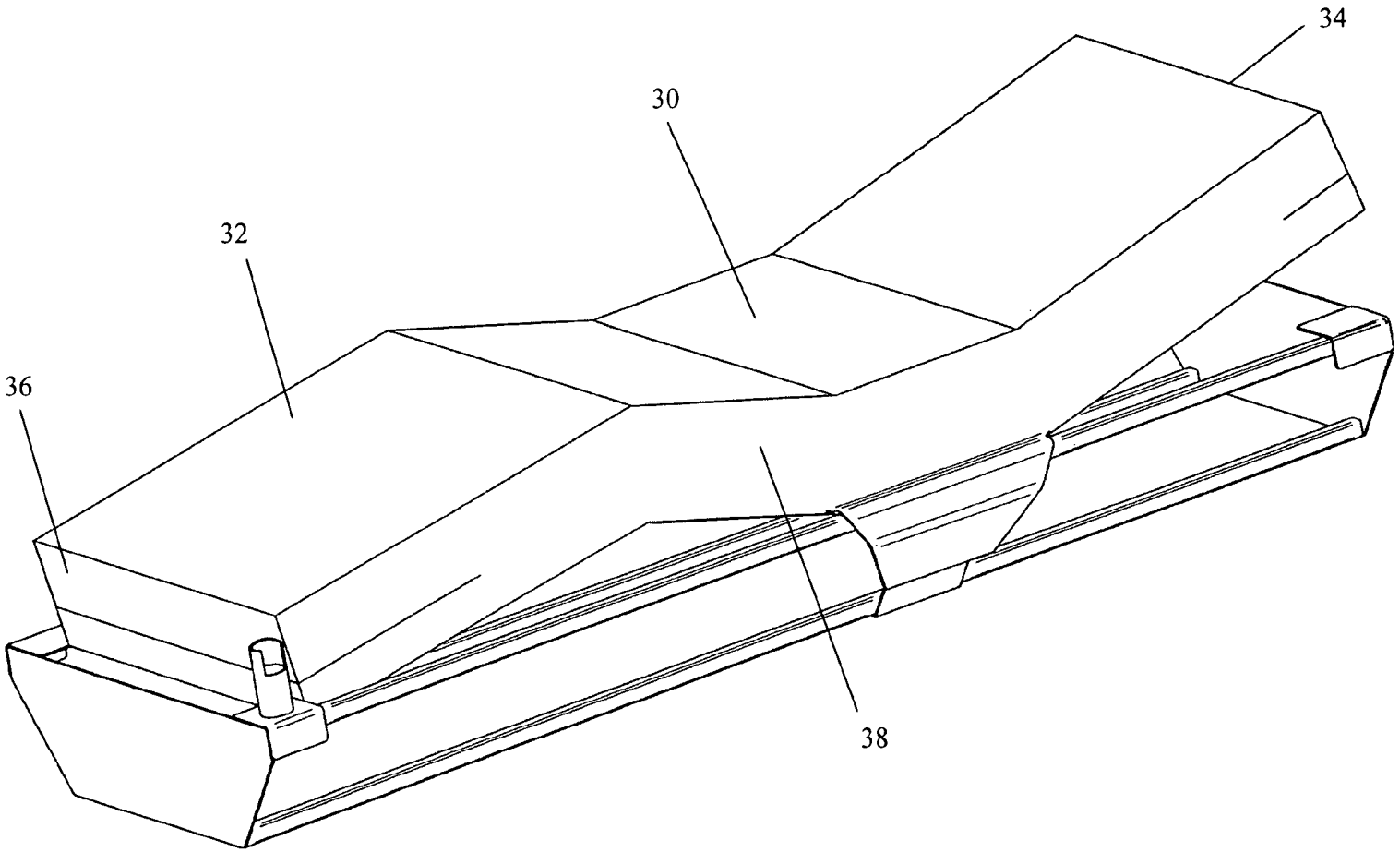
FIG. 1B depicts a foot end perspective view of an adjustable bed and a first embodiment of a mattress and bed deck cover.
Figures 2A, 2B:
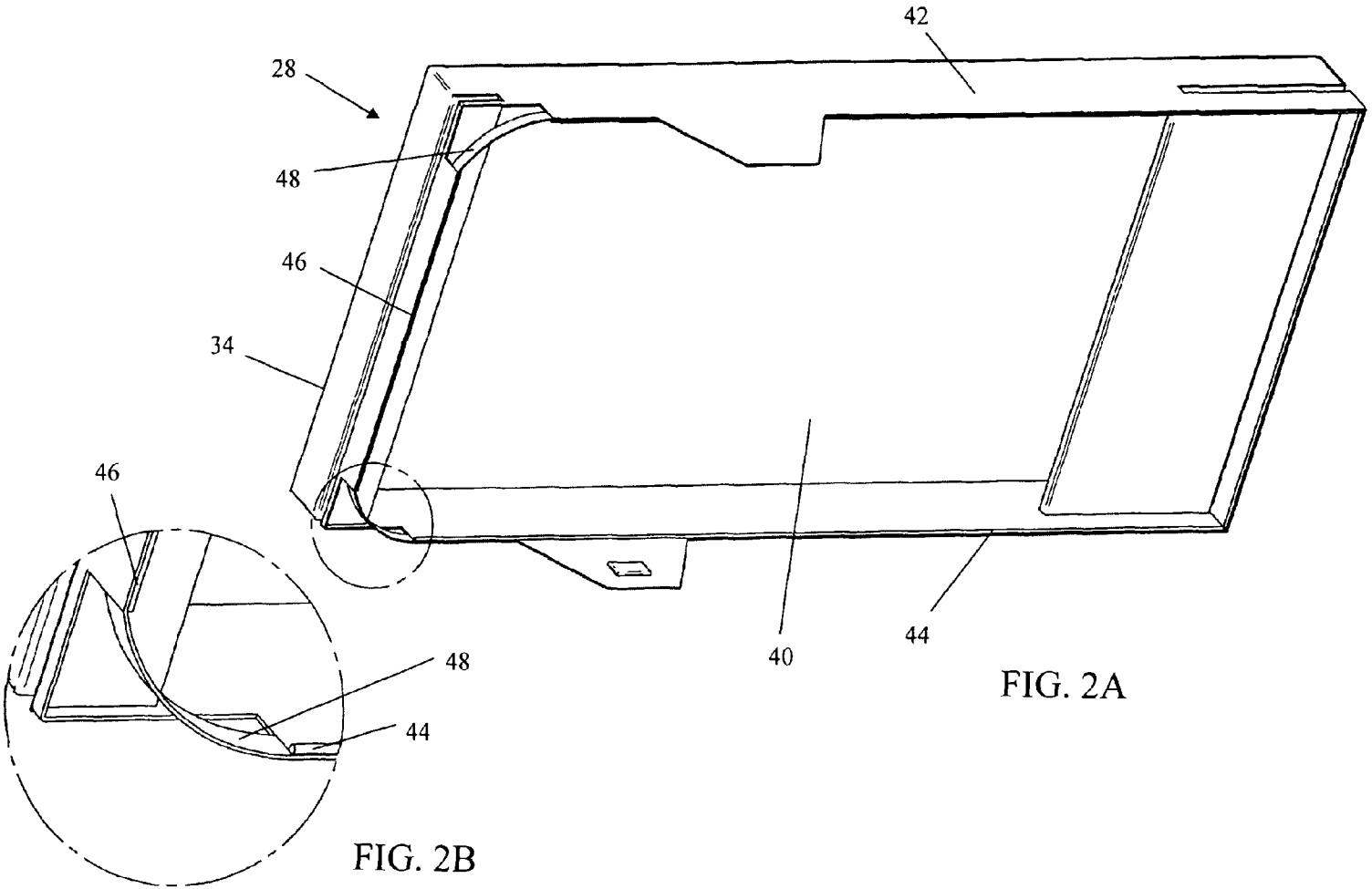
FIG. 2A depicts a bottom perspective view of the first embodiment of a mattress and bed deck cover.
FIG. 2B depicts a detail view of the bottom perspective view of the first embodiment of a mattress and bed deck cover.
Figure 3:
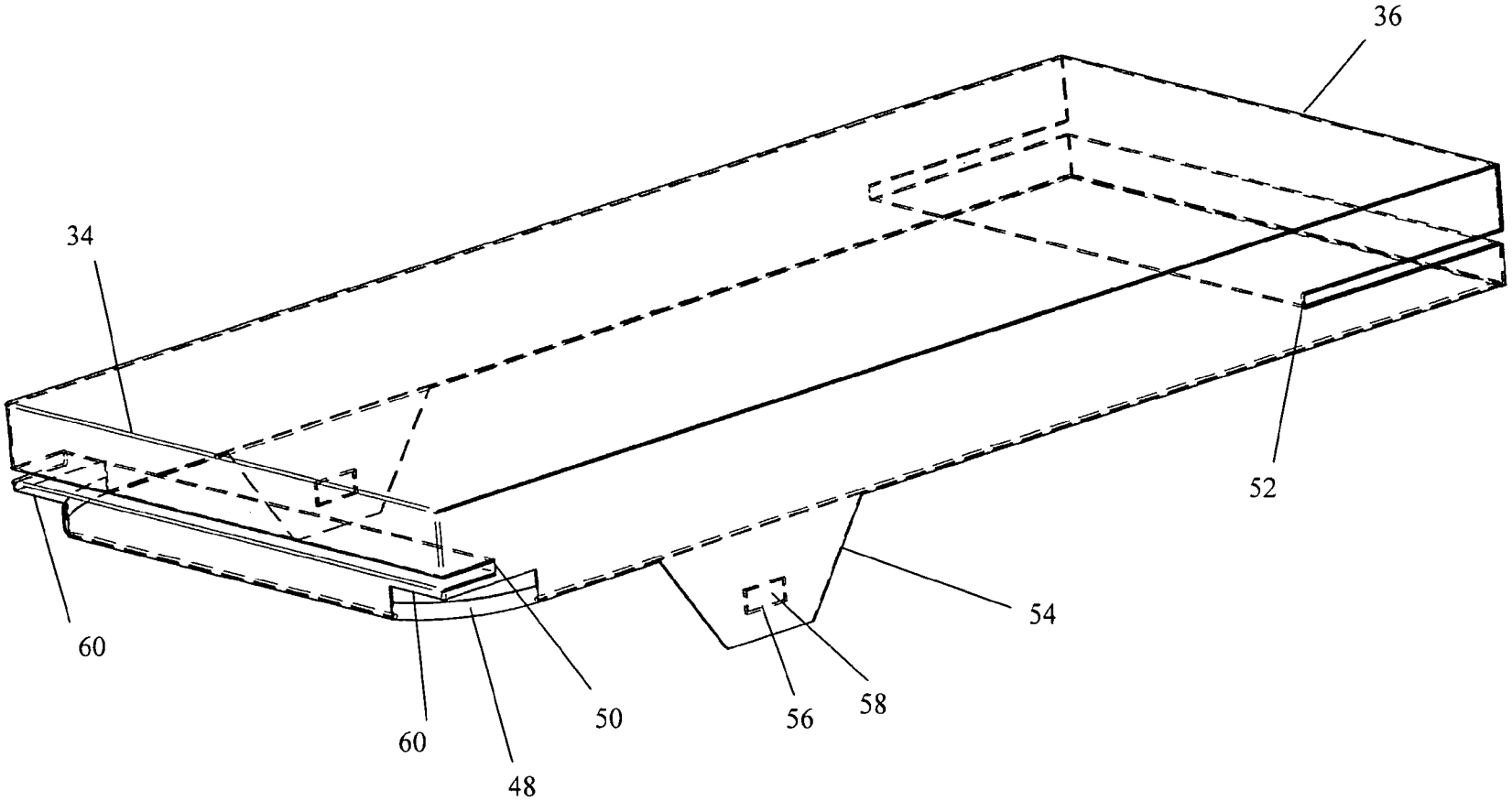
FIG. 3 depicts a hidden line head end perspective view of the first embodiment of a mattress and bed deck cover.

FIGS. 1-3 depict a first embodiment of a mattress and bed deck cover. As shown in FIG. 1A, a mattress 10 includes a mattress top 12, mattress sides 14, and mattress bottom 16. An adjustable bed 18 incorporates a bed deck 20 which supports and underlies the mattress 10. The bed deck 20 includes a bed deck top 22, bed deck sides 24, and bed deck bottom 26. The bed deck 20 also includes at least one pivot point 28 about which the bed deck 20 and mattress 10 may be articulated. As shown in FIG. 1B, the mattress and bed deck cover 30 includes a top surface 32, a head end 34 descending from the top surface 32, a foot end 36 descending from the top surface 32 and opposing the head end 34, and a pair of opposing sides 38 descending from the top surface 32 and substantially perpendicular to the head end 34 and the foot end 36 and connected thereto. The cover 30 may enclose at least the mattress top 12, mattress sides 14, and at least a portion of the mattress bottom 16, and at least a portion of the bed deck top 22 and bed deck sides 24. A person lying on the cover 30, mattress 10, and bed deck 20 preferably orients his or her head towards the head end 34 and his or her feet towards the foot end 36.

The mattress and bed deck cover 30 is preferably constructed of a liquid-impermeable fabric with a film coating. In a preferred embodiment, the fabric is a multi-directional stretch polyester fabric with welded or sealed seams and corners. In this embodiment, the mattress and bed deck cover 30 is suitable for disinfection using healthcare laundering techniques. As shown in FIGS. 2A and 2B, the mattress and bed deck cover 30 includes an inner surface 40, which contacts the mattress 10 and bed deck 20, and an outer surface 42, which is exposed to the environment. In a preferred embodiment, the film coating is polyurethane and is only present on the outer surface 42. The film coating preferably incorporates an agent with antimicrobial and/or antifungal properties such as, for example, antimicrobial metal. In a preferred embodiment, the film coating contains borophosphosilicate glass carriers containing silver ions. In this preferred embodiment, the film coating provides the cover 30 with a substantially nonleaching antimicrobial film coating.

The mattress and bed deck cover 30 includes means for removably fixing the cover 30 in relation to the mattress 10 and bed deck 20. In one embodiment, the means for removably fixing the cover 30 is at least one elastic band. In the first embodiment depicted in FIGS. 1-3, the mattress and bed deck cover 30 includes a long elastic band 44, a short elastic band 46, and two straps 48 that collectively draw the mattress and bed deck cover 30 under the bed deck 20 for retention. In this embodiment, the cover 30 encloses at least a portion of the bed deck bottom 26. As shown in FIG. 2B, the long elastic band 44, short elastic band 46, and straps 48 are sewn or welded into the lower edge of the mattress and bed deck cover 30. The short elastic band 46 located at the head end 34, the two straps 48 located at the corners adjacent to the head end 34, and the long elastic band 44 collectively define the opening of a cavity into which the mattress 10 is positioned. In an alternate embodiment, the mattress and bed deck cover 30 includes a single long elastic band 44 that defines the opening of the cavity. In this alternate embodiment, the mattress and bed deck cover 30 lacks straps 48 and the short elastic band 46. In other embodiments, the mattress and bed deck cover 30 may employ hooks, fasteners, buttons, magnets, hook and loop attachments or other suitable means or combination of means for removably fixing the mattress and bed deck cover 30 in relation to the mattress 10 and bed deck 20.

As shown in FIG. 3, the mattress and bed deck cover 30 includes a head end channel 50 located at the head end 34 of the cover 30 and extending the width of the head end 34 and a portion of the length of the sides 38. The head end channel 50 permits a fitted sheet to wrap around the head end corners of the mattress 10, while still preventing contaminants from contacting the mattress 10 and bed deck 20.

The mattress and bed deck cover 30 also includes a foot end channel 52 located at the foot end 36 of the cover 30 and extending the width of the foot end 36 and a portion of the length of the sides 38. The foot end channel 52 permits a fitted sheet to wrap around the foot end corners of the mattress 10 and permits flat sheets and blankets to be tucked between the mattress 10 and bed deck 20, while still preventing contaminants from contacting the mattress 10 and bed deck 20.

To cover locations which may be especially susceptible to contamination, such as pivot points 28, the cover may include at least one flap 54. Each flap 54 descends from the one of the sides 38 of the cover 30. Each flap 54 includes attachment means to position the flap 54 to removably cover a location on the adjustable bed 18 and, as depicted in FIG. 1B, remain in place as the bed 18 is articulated. In this first embodiment, a sealed pocket 56 is formed by placing two layers of polyurethane on the inner surface 40 of the flap 54, inserting a magnet 58 between the layers, folding the edges of the flap 54 over the polyurethane layers, and welding the layers of polyurethane to the inner flap 54. The magnet 58 allows the flap 54 to be removably attached to the bed deck 20 to provide extra coverage. Any other suitable attachment means for removably attaching the flap 54 to the bed 18, such as, for example, hooks, buttons, fasteners, straps, or a plurality of magnets may be used. In a preferred embodiment (not shown), the pocket 56 is divided into two compartments each containing a magnet 58.

The adjustable bed 18 may include at least one device, such as, for example bed rail, I.V. holder, trapeze adapter, or control for the bed 18. One style of adjustable bed 18 includes two devices attached to the bed deck 20, one located near each of the corners of the bed deck 20 adjacent to the head end 34. These devices are emergency release handles used to quickly lower the head end 34 of the adjustable bed 18 to position a person lying on the adjustable bed 18 into a prone position, as required to administer CPR. To provide access to these devices, the first embodiment of a mattress and bed deck cover 30 includes at least one cutout 60. More specifically, the cover 30 includes a cutout 60 at each of the corners of the mattress and bed deck cover 30 adjacent to the head end 34. Each cutout 60 is sized to accept one of the devices, and thus corresponds to both the location and shape of the device. In this first embodiment, a strap 48 extends across cutout 60, whereby strap 48 and cutout 60 combine to surround the device, providing access to device while maintaining coverage of the bed deck 20 and retention of the mattress and bed deck cover 30 on the mattress 10 and bed deck 20. In other embodiments, the adjustable bed may include zero, one, or more than one devices. In these embodiments, the mattress and bed deck cover 30 includes one cutout 60 and one strap 48 per device. In an embodiment without any devices, the mattress and bed deck cover 30 may include a single long elastic band 44 as its means for removably fixing the cover 30 in relation to the mattress 10 and bed deck 20. In this embodiment, the mattress and bed deck cover 30 lacks strap 48, cutout 60, and short elastic band 46.

In the first embodiment, the bed deck 20 is 36 (91 cm) inches wide by 80 inches (203 cm) long by 1.5 inches (3.8 cm) high. In this embodiment, the mattress 10 is sized 36.5 inches (93 cm) wide by 80 inches (203 cm) long by 6 inches (15 cm) high. In this embodiment, the mattress and bed deck cover 30 is sized to snugly fit the mattress 10 and bed deck 20. The mattress and bed deck cover 30 is about 80 inches (203 cm) in long, 36.5 inches (93 cm) wide and 7.375 inches (18.7 cm) high.

The first embodiment includes two cutouts 60 located at the corners of the cover 30 adjacent to the head end 34. Each cutout 60 has overall slot dimensions of about 11.5 inches (29.2 cm), with 4.5 inches (11.4 cm) along the head end 34 and 7.0 inches (17.8 cm) along the sides 38 of the cover 30. Each cutout is about 1.25 inches (3.18 cm) inches in height. Each strap 48 is about 9.5 inches (21.1 cm) long, about 1.0 inch (2.54 cm) wide, and constructed from woven nylon or polyester. In this embodiment the head end channel 50 has a length of about 4.0 inches (10.2 cm) and the foot end channel 52 has a length of about 15 inches (38.1 cm). The channels 50, 52 are located on the head end 34 and foot end 36, respectively, at a height of about 4.125 inches (10.5 cm) from the top surface 32 of the cover 30. The channels 50, 52 extend the full width of the cover 30, and are about 0.625 inches (1.6 cm) in height. Each flap 54 is about 15.25 inches (38.7 cm) in length and narrows to about 6.5 inches (16.5 cm) in length at an angle of about 56 degrees as it descends from the side 38 of the cover 30, forming an isosceles trapezoidal shape. Each flap 54 is about 6.5 inches (16.5 cm) in height. Two panels of polyurethane substantially corresponding to the size and shape of the flap 54 are welded to the inner surface 40 of each flap 54, forming a sealed pocket 56 which encloses a magnet 58. In a preferred embodiment (not shown), the pocket 56 is divided into two compartments each containing a magnet 58.

This first embodiment describes a mattress and deck cover 30 sized to fit a particular mattress used in the healthcare industry. In other embodiments, the mattress and bed deck cover 30 may be sized to fit crib, twin/single, full/double, queen, king, or non-standard sized mattresses.

Figure 4:
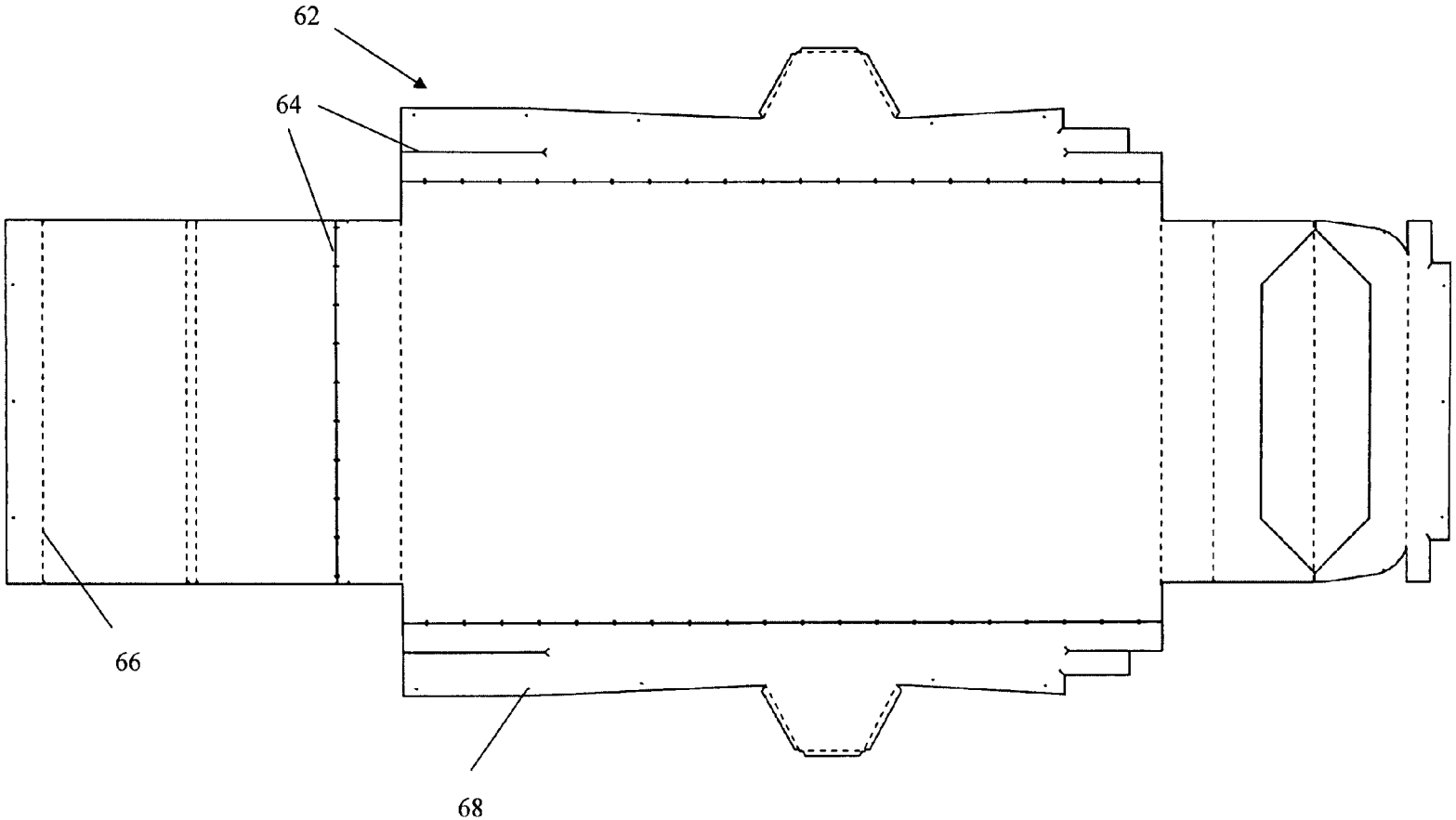
FIG. 4 depicts a pattern layout for the first embodiment of a mattress and bed deck cover.

FIG. 4 depicts a pattern layout 62 of the first embodiment of a mattress and bed deck cover 30. Cut lines 64 in the fabric are indicated by solid lines. Fold lines 66 are indicated by dashed lines. A plurality of marker holes 68 are used to place the fabric on locator pins when individual panels are sewn or welded together. These marker holes 68 are located in the seam allowance of the cover.

Figure 5A:
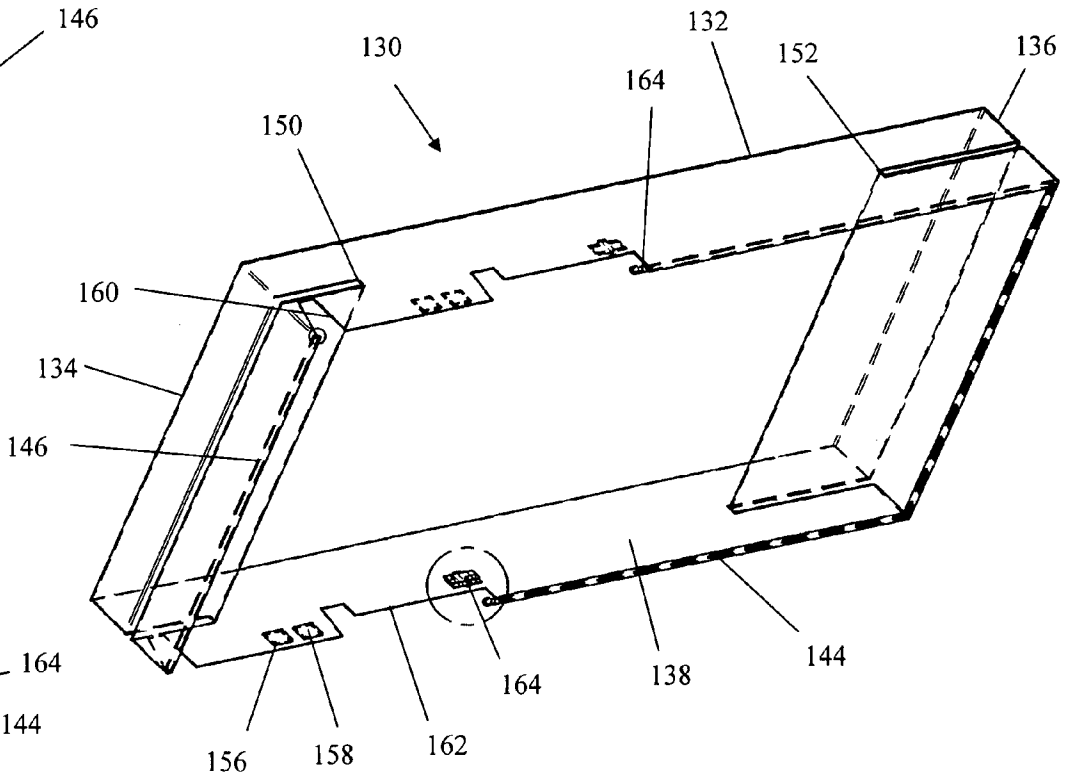
FIG. 5A depicts a hidden line bottom perspective view of a second embodiment of a mattress and bed deck cover.
Figure 5C:
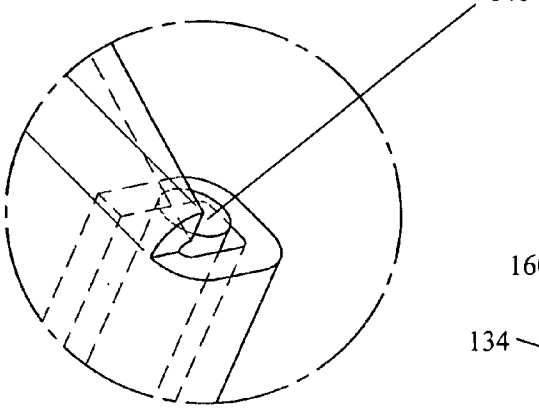
FIG. 5C depicts a detail view of a hidden line bottom perspective view of the second embodiment of a mattress and bed deck cover.
Figure 5B:
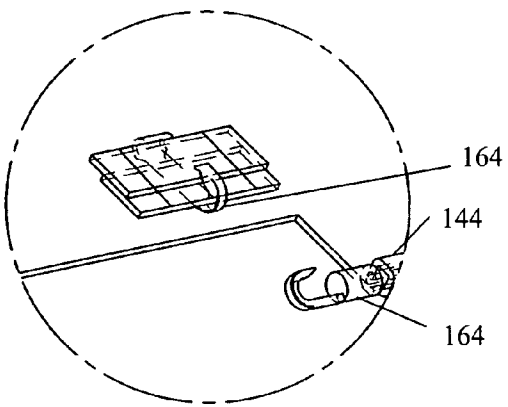
FIG. 5B depicts a detail view of a hidden line bottom perspective view of the second embodiment of a mattress and bed deck cover.

FIG. 5 depicts a second embodiment of a mattress and bed deck cover 130. In this second embodiment, the means for removably fixing the cover 130 in relation to the mattress 10 and bed deck 20 is a long elastic band 144, a short elastic band 146, and a plurality of magnets 158. The magnets 158 are enclosed within sealed pockets 156 formed by welding fabric to the inner surface 40 of the cover 130. In this second embodiment, the means for removably fixing the cover 130 further includes a plurality of hooks 164. As shown in FIG. 5B, the hooks 160 may be attached to an elastic band 144, 146 or attached directly to the cover 130 by sewing fabric over the hooks 164.

In this second embodiment, the cover 130 includes a plurality of cutouts, including first cutouts 160 and second cutouts 162, in shapes and locations corresponding to devices attached to the bed deck 20. As indicated by the first and second embodiments, the present invention may include any number or arrangement of cutouts 60, 160, 162 to fit different styles of beds 18 and provide access to devices extending therefrom.

In the second embodiment, the bed deck 20 is 36 (91 cm) inches wide by 80 inches (203 cm) long by 1.5 inches (3.8 cm) high. In this embodiment, the mattress 10 is sized 36.5 inches (93 cm) wide by 80 inches (203 cm) long by 6 inches (15 cm) high. In this embodiment, the mattress and bed deck cover 130 is sized to snugly fit the mattress 10 and bed deck 20. The mattress and bed deck cover 130 is about 80 inches (203 cm) in long, 36.5 inches (93 cm) wide and 7.375 inches (18.7 cm) high.

In this second embodiment the head end channel 150 has a length of about 9.0 inches (22.9 cm), is located at a height of about 4.625 inches (11.75 cm) from the top surface 132 of the cover 130, and has a height of 0.625 inches (1.6 cm). The foot end channel 152 has a length of about 15 inches (38.1 cm), is located at a height of about 4.75 inches (12.1 cm) from the top surface 132 of the cover 130, and has a height of 0.375 inches (1.0 cm). The channels 150, 152 extend the full width of the cover 130. Each side 138 of the cover includes two pockets 156 1.5 inches (3.8 cm) in height and 3 inches (7.6 cm) in length. The pockets 156 are located close to the bottom of the sides 138 and are respectively positioned about 12 inches (30.5 cm) and 15.25 inches (38.7 cm) from the head end 134. Each pocket 156 encloses a magnet 158.

The first cutouts 160 begin at the bottom edge of the sides 138, adjacent to the head end 134 of the cover 130, and increase in height at a angle of about 73 degrees to a height of about 5.25 inches (13.3 cm). The first cutouts 160 then extend for a length of about 1.7 inches (4.3 cm), for a total length of about 3.3 inches (8.4 cm). The second cutouts 162 begin at the bottom edge of the sides 138 of the cover 130 at a location 19 inches (48.3 cm) from the head end 134 with a height of 3.5 inches (8.9 cm). The second cutouts 162 extend for a length of 3 inches (7.6 cm), decrease to a height of 2 inches (5.1 cm), and extend for an additional 14 inches (35.6 cm), for a total length of 17 inches (43.2 cm).

In a preferred embodiment, the mattress and bed deck cover 30, 130 is capable of being laundered using healthcare laundering techniques. The cover 30, 130 is manufactured primarily using fabric welds. In present invention, 0.125 inch (0.318 cm) fabric welds are used with a pull strength of about 19.8 pounds per square inch (6.895 kPa), which are capable of withstanding the agitation and high temperature of the laundering process. In addition, the hemmed edges surrounding the long elastic band 44, 144 and short elastic band 46, 146 may incorporate a plurality of exit holes (not shown) approximately 0.125 inches (0.318 cm) in diameter. The exit holes permit trapped water to drain out during the laundering process. The hemmed edges surrounding the elastic bands 44, 144, 46, 146 are the only hemmed attachments on the cover; all others are welded. The magnets 58, 158 preferably include an epoxy coating to protect them from damage during the laundering process.

While the present invention is discussed primarily in context of a hospital setting, the mattress and bed deck cover 30, 130 may be used in non-hospital settings, or with non-adjustable beds. For example, the present invention may be used in nursing homes or hospice facilities. The present invention may also be used in the home, for example, for individuals with incontinence issues or with weeping sores, both of which would benefit from an antimicrobial sleeping surface which prevents contamination of underlying bedding.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A mattress and bed deck cover, said cover comprising:
- a top surface;
- a head end descending from said top surface;
- a foot end descending from said top surface and opposing said head end;
- a pair of opposing sides descending from said top surface and substantially perpendicular to said head end and said foot end and connected thereto;
- means for removably fixing said cover in relation to a mattress and a bed deck;
- a head end channel located between a top edge and a bottom edge of said head end, said head end channel extending the width of said head end and a portion of the length of said sides;
- a foot end channel located between a top edge and a bottom edge of said foot end, said foot end channel extending the width of said foot end and a portion of the length of said sides; and
- at least one flap descending from a bottom of at least one of said pair of opposing sides and removably attachable to said bed deck;
- wherein said cover is sized to enclose the mattress and at least a portion of the bed deck, with said head end channel and said foot end channel oriented to interpose a portion of the mattress and the bed deck.

2. The mattress and bed deck cover of claim 1, further comprising at least one cutout.

3. The mattress and bed deck cover of claim 2, wherein said at least one cutout corresponds to the shape and location of at least one device attached to said bed deck.

4. The mattress and bed deck cover of claim 1, wherein said at least one flap is positioned to removably cover at least one pivot point of said bed deck.

5. The mattress and bed deck cover of claim 1, wherein said cover is constructed of a liquid-impermeable, multi-directional stretch fabric.

6. The mattress and bed deck cover of claim 1, wherein said cover includes a substantially nonleaching antimicrobial film coating.

7. The mattress and bed deck cover of claim 1, wherein said cover includes a film coating incorporating an antimicrobial agent.

8. The mattress and bed deck cover of claim 7, wherein said agent is antimicrobial metal.

9. The mattress and bed deck cover of claim 8, wherein said antimicrobial metal is silver ions contained within glass carriers.

10. The mattress and bed deck cover of claim 1, wherein said cover is adapted to be laundered at a temperature of at least 160° Fahrenheit.

11. The mattress and bed deck cover of claim 1, wherein said cover is constructed using fabric welds.

12. A mattress and bed deck cover, said cover comprising:

a top surface;

a head end descending from said top surface;

a foot end descending from said top surface and opposing said head end;

a pair of opposing sides descending from said top surface and substantially perpendicular to said head end and said foot end and connected thereto;

at least one elastic band;

a head end channel located between a top edge and a bottom edge of said head end, said head end channel extending the width of said head end and a portion of the length of said sides;

a foot end channel located between a top edge and a bottom edge of said foot end, said foot end channel extending the width of said foot end and a portion of the length of said sides; and at least one flap descending from a bottom of at least one of said pair of opposing sides and removably attachable to said bed deck;

wherein said cover is sized to enclose a mattress and at least a portion of a bed deck, with said head end channel and said foot end channel oriented to interpose a portion of said mattress and said bed deck.

13. The mattress and bed deck cover of claim 12, comprising at least one elastic band attached to said sides for drawing said cover beneath said bed deck for retention.

14. The mattress and bed deck cover of claim 12, further comprising at least one magnet for removably attaching said cover to said bed deck.

15. The mattress and bed deck cover of claim 12, further comprising at least one hook for removably attaching said cover to said bed deck.

16. The mattress and bed deck cover of claim 12, further comprising at least one strap arranged in sequence with said at least one elastic band, said at least one elastic band and said at least one strap for cooperatively drawing said cover beneath said bed deck for retention.

17. The mattress and bed deck cover of claim 12, further comprising a substantially nonleaching antimicrobial film coating.

18. The mattress and bed deck cover of claim 12, wherein said at least one flap includes a magnet for removably attaching said flap to said bed.

19. The mattress and bed deck cover of claim 12, wherein said cover further comprises at least one cutout corresponding to the location and shape of at least one device attached to said bed deck.

20. The mattress and bed deck cover of claim 12, wherein said cover is constructed using fabric welds.

* * * * *